US012654056B2

(12) United States Patent
Yang

(10) Patent No.: US 12,654,056 B2
(45) Date of Patent: Jun. 16, 2026

(54) TRAINING APPARATUS CAPABLE OF BEING QUICKLY COMBINED INTO DUMBBELL AND KETTLEBELL

(71) Applicant: Kangming Yang, Zhenping (CN)

(72) Inventor: Kangming Yang, Zhenping (CN)

( * ) Notice: Subject to any disclaimer, the term of this patent is extended or adjusted under 35 U.S.C. 154(b) by 58 days.

(21) Appl. No.: 18/767,116

(22) Filed: Jul. 9, 2024

(65) Prior Publication Data

US 2024/0359046 A1 Oct. 31, 2024

(51) Int. Cl.
*A63B 21/072* (2006.01)

(52) U.S. Cl.
CPC ..... *A63B 21/0726* (2013.01)

(58) Field of Classification Search
None
See application file for complete search history.

(56) References Cited

U.S. PATENT DOCUMENTS 12,102,866 B2 * 10/2024 Wang ..... A63B 21/0722
12,138,503 B2 * 11/2024 Chen ..... A63B 21/072
12,214,239 B1 * 2/2025 Yu ..... A63B 21/0728
12,246,208 B2 * 3/2025 McCoy ..... A63B 21/0726
2009/0048079 A1 2/2009 Nalley
2017/0095687 A1 * 4/2017 Sonnon ..... A63B 21/0728
2017/0259107 A1 * 9/2017 Shalvi ..... A63B 21/0728
2022/0016465 A1 1/2022 Troiano et al.
2023/0173326 A1 * 6/2023 Yao ..... A63B 21/0728 482/107
2023/0173327 A1 * 6/2023 Wang ..... A63B 21/075 482/107
2023/0321474 A1 10/2023 Nalley
2024/0131385 A1 * 4/2024 Wang ..... A63B 21/0722
2024/0181288 A1 * 6/2024 Chen ..... A63B 21/0728

* cited by examiner

*Primary Examiner* — Joshua Lee
(74) *Attorney, Agent, or Firm* — Hemisphere Law, PLLC

(57) ABSTRACT

The present disclosure relates to the technical field of fitness equipment, more particularly to a training apparatus capable of being quickly combined into a dumbbell and a kettlebell. The training apparatus includes: a plurality of weight blocks, a kettlebell body and a handle; and a plurality of connecting mechanisms, the connecting mechanism including a snap ring, a snap-fit block and two abutting blocks. After rotation to place, the abutting blocks will autonomously extend out of the mounting grooves to lock the snap-fit block with a diagonal distribution. The above connection method is simple in operation and low in mounting difficulty, whereby the training apparatus is convenient to transform and achieves an effective combination of two in one. Furthermore, the handle can be received into the kettlebell body, reducing the risk of being lost.

5 Claims, 5 Drawing Sheets

TRAINING APPARATUS CAPABLE OF BEING QUICKLY COMBINED INTO DUMBBELL AND KETTLEBELL

TECHNICAL FIELD

The present disclosure relates to the technical field of fitness equipment, more particularly to a training apparatus capable of being quickly combined into a dumbbell and a kettlebell.

BACKGROUND

Modern urbanites are experiencing high working intensity, so exercising and running have gradually become popular. However, due to time constraint, it is impossible for them to go to the gym usually. Therefore, small sized exercising apparatuses are needed that can be used at home, among which dumbbells and kettlebells are the most common. If the two can be combined into one, not only can the cost for purchasing apparatuses be saved, but convenience can also be brought to storage and usage.

In order to address the above technical problems, existing training apparatuses often realize a transformation thereof employing threaded connection or lock-pin connection, thereby to achieve a combination of two in one. However, the above connection method is cumbersome, and it is needed to perform adjustment during the connection process, making the difficulty and time of transformation of the apparatus increased.

SUMMARY

It is an object of the present disclosure to provide a training apparatus capable of being quickly combined into a dumbbell and a kettlebell to address the above problems, which improves the issues that the training apparatus has difficulty in transformation and the transformation needs a long time.

The present disclosure achieves the above object employing the following technical solutions. A training apparatus capable of being quickly combined into a dumbbell and a kettlebell includes:

- a plurality of weight blocks, a kettlebell body and a handle; and
- a plurality of connecting mechanisms, the connecting mechanism including a snap ring, a snap-fit block and two abutting blocks, wherein one side of the weight block is formed with a circular groove, the snap ring is fixedly connected at an opening of the circular groove, inside the weight block are formed two mounting grooves intercommunicated with the circular groove, the abutting block is rotatably connected into the mounting groove, a torsion spring is provided at a position of rotation between the abutting block and the mounting groove, the snap-fit block is mounted correspondingly on the other side of the weight block, an end part of the handle or an end part of the kettlebell body. The above connection method is simple in operation and low in mounting difficulty, whereby the training apparatus is convenient to transform and achieves an effective combination of two in one.

Preferably, an opening of the snap ring has a protrusion forming a limit part, and an outer wall of the snap-fit block forms a protruded block used in fitting with the limit part. During the usage of the training apparatus, the snap ring and the snap-fit block can form an integral closed ring, enhancing the steadiness of snap-fit connection therebetween.

Preferably, a side surface of the weight block is formed with two hollow holes, the mounting groove is intercommunicated with the hollow hole, and the abutting block has one end extending through the mounting groove into the hollow hole. It is more convenient to disassemble the training apparatus and the steadiness of the training apparatus during usage is not affected.

Preferably, a side surface of the kettlebell body is formed with two receiving cavities, and the receiving cavity is matched with the handle in shape. When the training apparatus is used as a kettlebell form, the handle is received into the kettlebell body, reducing the risk of being lost.

Preferably, the end part of the kettlebell body, the end part of the handle and the other side of the weight block are each fixedly connected with a mounting block, and the mounting block is fixedly connected to the snap-fit block. It is convenient to replace the corresponding snap-fit block during later periods, thereby facilitating the easy maintenance of the training apparatus.

The present disclosure has the following beneficial effects.

In the above connecting mechanism, the snap-fit block and the snap ring are mutually matched in shape, which can quickly achieve a closed connection state. After rotation to place, the abutting blocks will autonomously extend out of the mounting grooves to lock the snap-fit block with a diagonal distribution. The above connection method is simple in operation and low in mounting difficulty, whereby the training apparatus is convenient to transform and achieves an effective combination of two in one. Furthermore, the handle can be received into the kettlebell body, reducing the risk of being lost.

Figure 1:
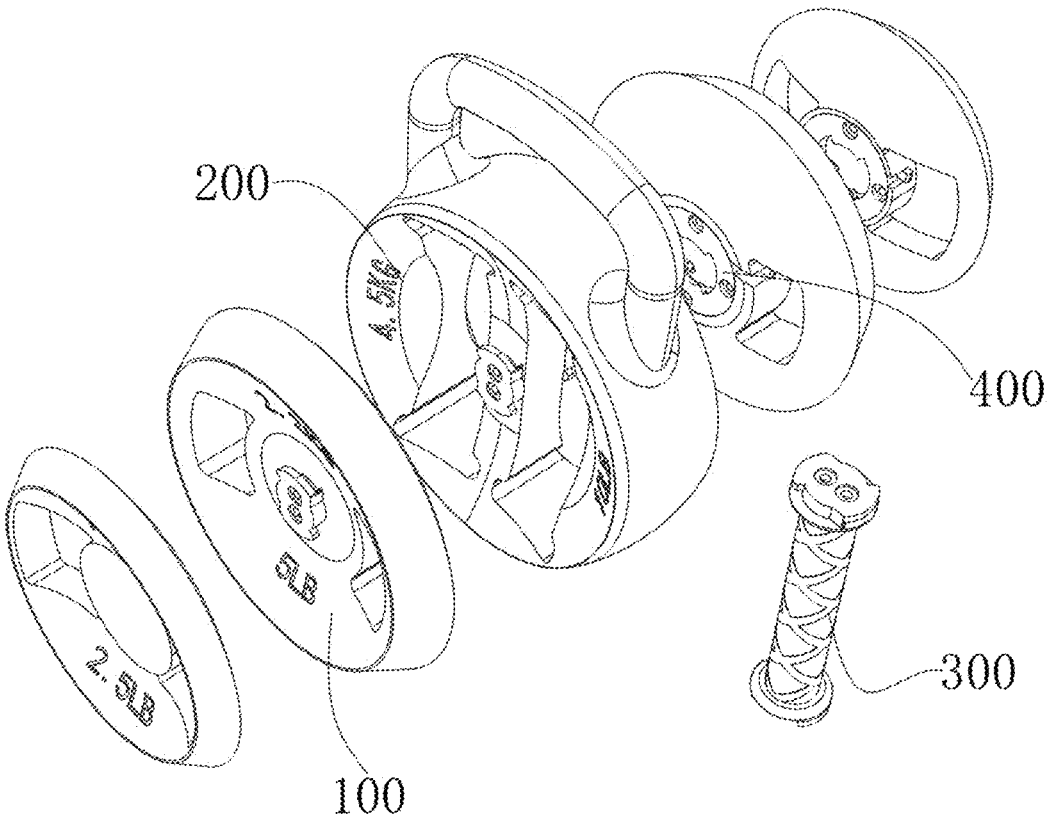
FIG. 1 is an exploded view of the present disclosure.

Reference numerals in the drawings are illustrated as below. 100, weight block; 110, mounting groove; 200, kettlebell body; 300, handle; 400, connecting mechanism; 410, snap ring; 420, snap-fit block; 430, abutting block; and 431, torsion spring.

DETAILED DESCRIPTION OF THE EMBODIMENTS

The technical solutions of the embodiments of the present disclosure will be clearly and completely described below with reference to the drawings of the embodiments of the present disclosure. Apparently, the described embodiments are merely certain embodiments of the present disclosure, rather than all of the embodiments. All of the other embodiments that a person skilled in the art obtains on the basis of the embodiments of the present disclosure without paying creative work are intended to fall within the protection scope of the present disclosure.

During specific implementation, as shown in FIG. 1 to FIG. 5, a training apparatus capable of being quickly combined into a dumbbell and a kettlebell includes:

a plurality of weight blocks 100, a kettlebell body 200 and a handle 300; and a plurality of connecting mechanisms 400, the connecting mechanism 400 including a snap ring 410, a snap-fit block 420 and two abutting blocks 430, wherein one side of the weight block 100 is formed with a circular groove, the snap ring 410 is fixedly connected at an opening of the circular groove, inside the weight block 100 are formed two mounting grooves 110 intercommunicated with the circular groove, the abutting block 430 is rotatably connected into the mounting groove 110, a torsion spring 431 is provided at a position of rotation between the abutting block 430 and the mounting groove 110, the snap-fit block 420 is mounted correspondingly on the other side of the weight block 100, an end part of the handle 300 or an end part of the kettlebell body 200.

Figure 2:
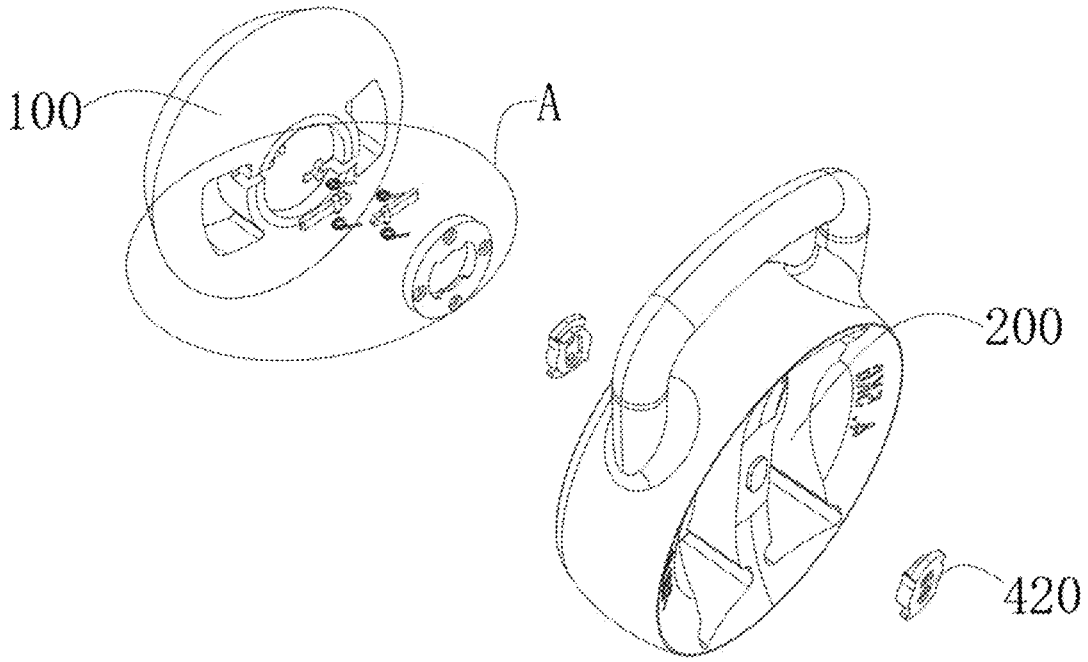
FIG. 2 is a connection diagram of a weight block, a kettlebell body and a connecting mechanism of the present disclosure.
Figure 3:
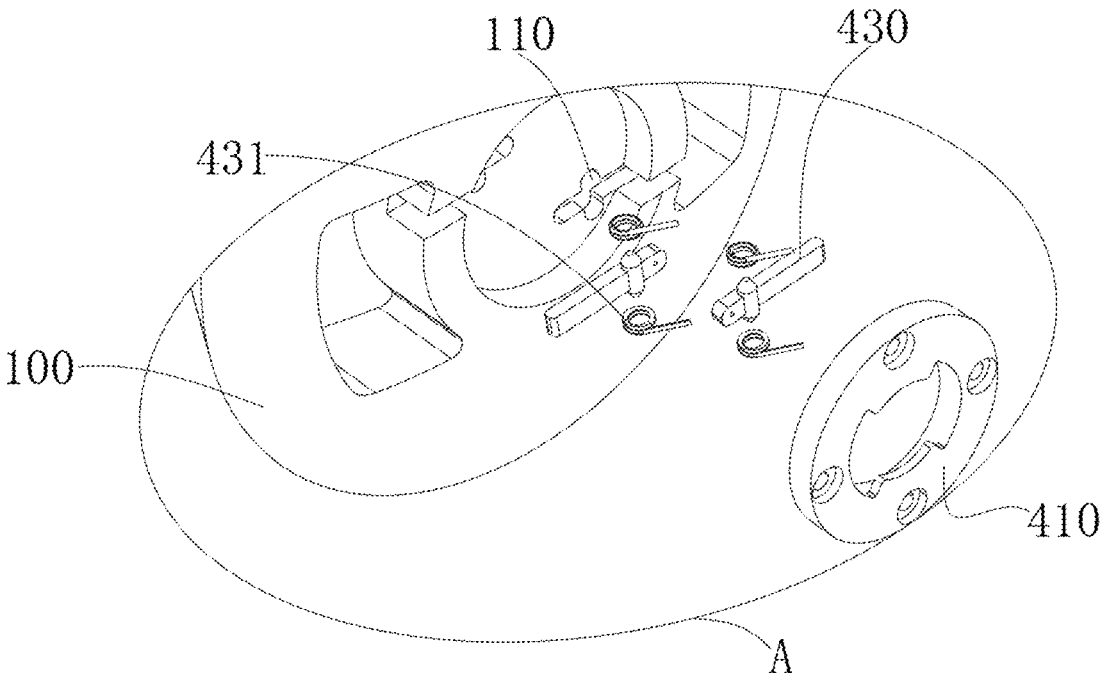
FIG. 3 is an enlargement view of part A in FIG. 2.
Figure 4:
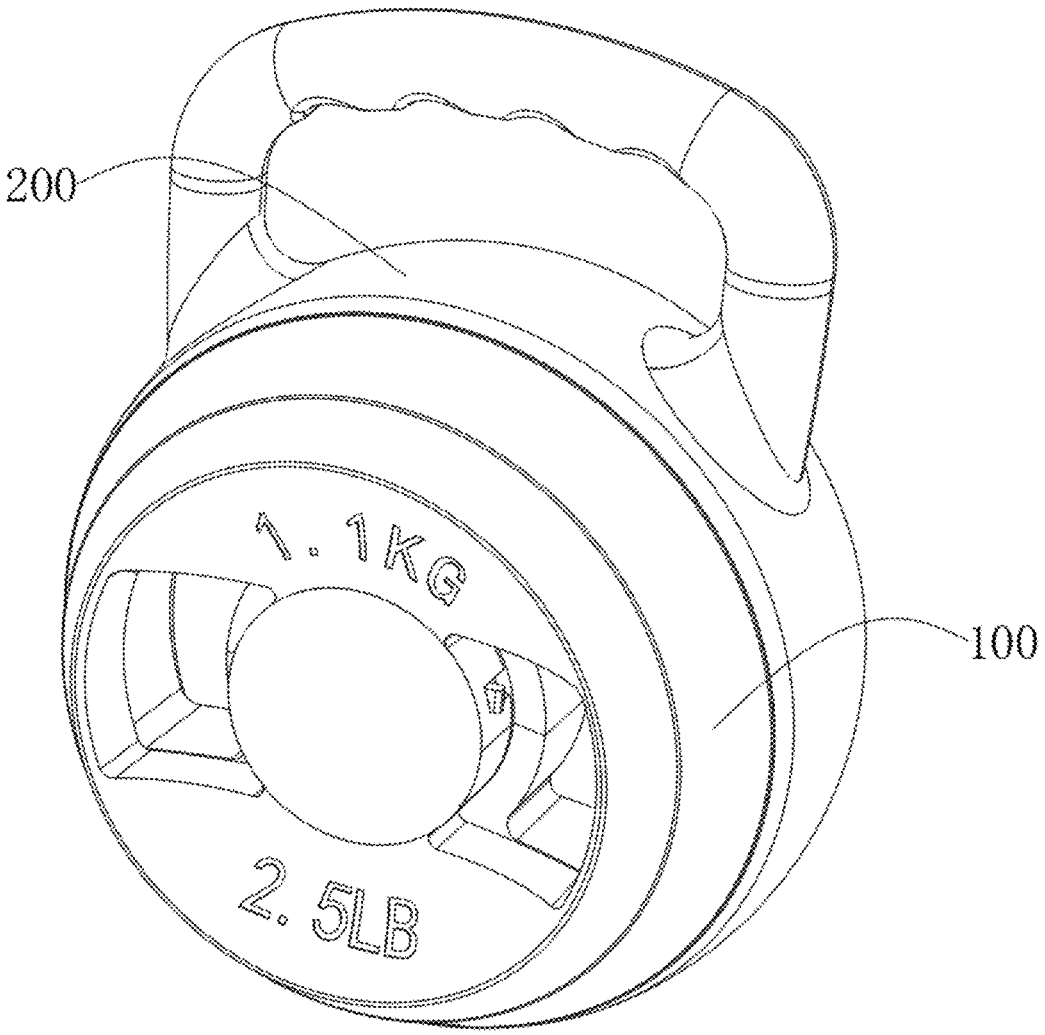
FIG. 4 is a structure diagram of a kettlebell form of the present disclosure.
Figure 5:
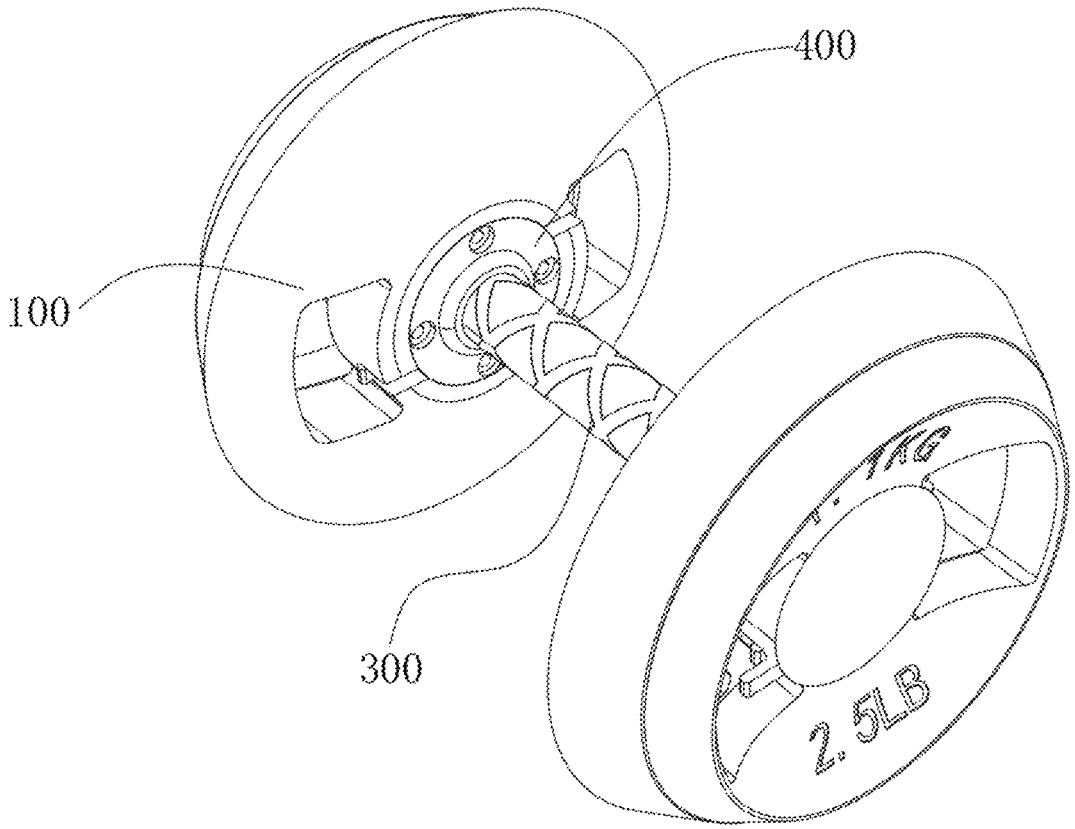
FIG. 5 is a structure diagram of a dumbbell form of the present disclosure.

As shown in FIG. 2 and FIG. 3, an opening of the snap ring 410 has a protrusion forming a limit part, and an outer wall of the snap-fit block 420 forms a protruded block used in fitting with the limit part.

In the present embodiment, after the snap-fit block 420 is rotated 90 degrees, the snap ring 410 and the snap-fit block 420 can form an integral closed ring, enhancing the steadiness of snap-fit connection therebetween.

As shown in FIG. 1, FIG. 2, FIG. 4 and FIG. 5, a side surface of the weight block 100 is formed with two hollow holes, the mounting groove 110 is intercommunicated with the hollow hole, and the abutting block 430 has one end extending through the mounting groove 110 into the hollow hole.

In the present embodiment, during a disassembly operation, a hand extends into the hollow hole of the weight block 100 and presses against the two abutting blocks 430 simultaneously from lateral sides, after which the other ends of the abutting blocks 430 are received into the mounting grooves 110, whereby it is more convenient to disassemble the training apparatus and the steadiness of the training apparatus during usage is not affected.

As shown in FIG. 1 and FIG. 2, a side surface of the kettlebell body 200 is formed with two receiving cavities, and the receiving cavity is matched with the handle 300 in shape.

In the present embodiment, when the training apparatus is used as a kettlebell form, the handle 300 is received into the receiving cavity before completing the installation of the other side of the kettlebell body 200. The design of receiving the handle 300 into the kettlebell form reduces the risk of the handle 300 being lost.

As shown in FIG. 2, the end part of the kettlebell body 200, the end part of the handle 300 and the other side of the weight block 100 are each fixedly connected with a mounting block, and the mounting block is fixedly connected to the snap-fit block 420.

In the present embodiment, it is more convenient to mount the snap-fit block 420 and it is also convenient to replace the corresponding snap-fit block 420 during later periods, thereby facilitating the easy maintenance of the training apparatus.

The working principle is as follows. When it is needed to transform the training apparatus into a kettlebell, enter the snap-fit block 420 into a mounting area from a notch of the snap ring 410; by the time, the snap-fit block 420 squeezes against the abutting blocks 430, and the abutting blocks 430 are squeezed into the mounting grooves 110. Then, the snap-fit block 420 is rotated 90 degrees, so that the limit part and the protruded block form into a closed state. Thereafter, the abutting blocks 430 lose the squeezing from the snap-fit block 420 and extend through the mounting grooves 110 under the function of the torsion springs 431 to limit two diagonal positions of the snap-fit block 420, thereby achieving a stable connection after transformation. Next, the handle 300 can be received into the receiving cavity. Similarly, corresponding weight blocks 100 can be mounted in sequence with the above principle. When it is needed to transform the training apparatus into a dumbbell, the operation is similar to the above principle. During the disassembly of the apparatus, a hand extends into the hollow hole of the weight block 100 and presses against the two abutting blocks 430 simultaneously from lateral sides, after which the other ends of the abutting blocks 430 are received into the mounting grooves 110 and in the meantime the abutting blocks 430 do not lock the snap-fit block 420. Then, rotate the snap-fit block 90 degrees to complete the disassembly of the training apparatus.

In addition, it should be understood that although the present specification has been described according to embodiments, it does not mean that each embodiment includes only one independent technical solution. Such narration method of the specification is merely for clear illustration. Those skilled in the art should view the specification as an entirety. Technical solutions in each embodiment can be properly combined to form some other embodiments that those skilled in the art can understand.

What is claimed is:

1. A training apparatus capable of being quickly combined into a dumbbell and a kettlebell, comprising:

a plurality of weight blocks (100), a kettlebell body (200) and a handle (300); and a plurality of connecting mechanisms (400), wherein within each of the plurality of connecting mechanisms (400):

each connecting mechanism (400) comprising a snap ring (410), a snap-fit block (420) and two abutting blocks (430), wherein one side of each of the plurality of weight blocks (100) is formed with a circular groove, the snap ring (410) is fixedly connected at an opening of the circular groove, inside each of the plurality of weight blocks (100) are formed two mounting grooves (110) intercommunicated with the circular groove, the two abutting blocks (430) are rotatably connected into the two mounting grooves (110) respectively, a torsion spring (431) is provided at a position of rotation between each of the two abutting blocks (430) and a corresponding one of the two mounting grooves (110), the snap-fit block (420) is mounted correspondingly on another side of each of the plurality of weight blocks (100), an end part of the handle (300) or an end part of the kettlebell body (200).

2. The training apparatus capable of being quickly combined into the dumbbell and the kettlebell according to claim 1, wherein an opening of the snap ring (410) of each connecting mechanism (400) has a protrusion forming a limit part, and an outer wall of the snap-fit block (420) of each connecting mechanism (400) forms a protruded block used in fitting with the limit part.

3. The training apparatus capable of being quickly combined into the dumbbell and the kettlebell according to claim 1, wherein a side surface of each of the plurality of weight blocks (100) is formed with two hollow holes, the two mounting grooves (110) of each weight block (100) are intercommunicated with the two hollow holes of each weight block (100) respectively, and each of the two abutting blocks (430) of each connecting mechanism (400) has one end extending through a corresponding mounting groove (110) into a corresponding hollow hole.

4. The training apparatus capable of being quickly combined into the dumbbell and the kettlebell according to claim 1, wherein a side surface of the kettlebell body (200) is formed with two receiving cavities, and the two receiving cavities are corporately matched with the handle (300) in shape.

5. The training apparatus capable of being quickly combined into the dumbbell and the kettlebell according to claim 1, wherein the end part of the kettlebell body (200), the end part of the handle (300) and the other-side of the weight block (100) are each fixedly connected with a mounting block, and the mounting block is fixedly connected to the snap-fit block (420) of one of the plurality of connecting mechanisms (400).

* * * * *